United States Patent [19]

King

[11] 4,147,955

[45] Apr. 3, 1979

[54] TRAVELLING WAVE TUBES

[75] Inventor: Robin C. M. King, Chelmsford, England

[73] Assignee: English Electric Valve Company Limited, Chelmsford, England

[21] Appl. No.: 760,398

[22] Filed: Jan. 18, 1977

[30] Foreign Application Priority Data

Apr. 13, 1976 [GB] United Kingdom ..... 4645/76

[51] Int. Cl.[2] ..... H01J 25/34

[52] U.S. Cl. ..... 315/3.5; 315/3.6; 315/37.3

[58] Field of Search ..... 315/3.5, 3.6, 39.3

[56] References Cited

U.S. PATENT DOCUMENTS

| | | | |
|---|---|---|---|
| 3,221,205 | 11/1965 | Sensiper | 315/3.5 |
| 3,360,679 | 12/1967 | Rubert | 315/3.5 |
| 3,365,607 | 1/1968 | Ruetz et al. | 315/3.5 |
| 3,412,279 | 11/1968 | Allen et al. | 315/3.5 |
| 3,454,817 | 7/1969 | Shively et al. | 315/3.5 |
| 3,466,576 | 9/1969 | Bert | 315/3.5 |
| 3,471,738 | 10/1969 | Bert | 315/3.5 |
| 3,594,605 | 7/1971 | Blinn | 315/3.5 |
| 3,602,766 | 8/1971 | Grant | 315/3.5 |

*Primary Examiner*—Saxfield Chatmon, Jr.
*Attorney, Agent, or Firm*—Diller, Ramik & Wight

[57] ABSTRACT

A travelling wave tube is provided with a slow wave structure consisting of clover leaf cavities in which frequency selective attenuators are present in subsidiary cavities formed within the nose of a clover leaf cavity. Each attenuator consists of dielectric material loaded with attenuation material. The use of the invention enables the coupling properties of the clover leaf cavities and their resonant frequencies to be chosen to provide optimum oscillation suppression.

15 Claims, 9 Drawing Figures

TRAVELLING WAVE TUBES

This invention relates to travelling wave tubes and in particular to travelling wave tubes of the cloverleaf slow wave circuit type.

In a travelling wave tube amplification takes place as a result of interaction between a stream of electrons and the axial electric field of the travelling wave.

A cloverleaf slow wave circuit is characterised by a series of passbands, some of which have axial electric fields. This is illustrated in the graph of FIG. 1 of the accompanying drawings in which angular frequency $\omega$ is plotted against phase change per circuit period $\beta L$.

Figure 1:
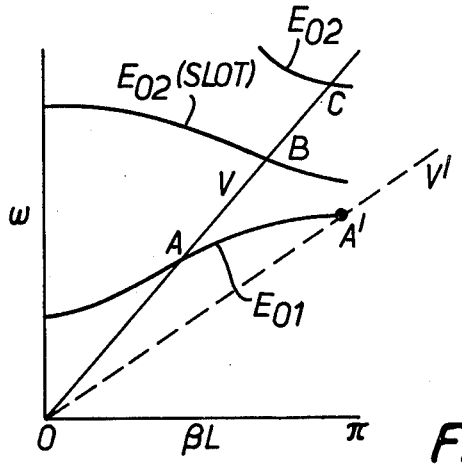

Referring to FIG. 1, a straight line passing through the origin is a line of constant velocity, so that a stream of electrons of velocity V will be synchronous and interact with the circuit wave ($E_{01}$, $E_{02}$ (slot), $E_{02}$) at points A, B and C. At point A the desired amplification takes place, but, at points B and C oscillation can take place if the wave impedance is high. If the beam velocity is reduced to V′ (shown dashed) by reducing the beam accelerating voltage — as occurs during the pulse rise and fall of a cathode pulsed tube — oscillation can take place at A′ because the wave impedance is very high near the ends of the passband.

In order to suppress oscillations, it is known to provide frequency selective attenuation over the range of frequencies at which oscillation can occur, without introducing excessive loss in the main operating band.

One method of achieving such frequency selective attenuation is to provide subsidiary cavities which contain attenuating material and are coupled into the cloverleaf cavities, as described in United Kingdom Pat. specification No. 1,280,960. These subsidiary cavities are placed partially in the nose of the cloverleaf cavity and the lossy material providing the required attenuation is sprayed onto the walls of the subsidiary cavities.

This known method of providing frequency selective attenuation suffers from a number of disadvantages. Despite the use of metallic posts in the centres of the subsidiary cavities to provide capacitive loading, the subsidiary cavities are still relatively large. The use of such metallic posts renders the subsidiary cavities critically dependent, as regards their resonant frequencies, upon the capacitive loading and differential expansion between the cavity and the metallic post will cause the resonant frequency of the subsidiary cavity to be effected. In addition, it is difficult, in practice, to achieve sufficient attenuation by spraying lossy material onto the inner surface of the subsidiary cavities.

The present invention seeks to provide an improved travelling wave tube of the cloverleaf slow wave circuit type in which the difficulties are reduced.

According to this invention a travelling wave tube of the cloverleaf slow wave circuit type includes frequency selective attenuation means in the form of a subsidiary cavity within a nose of a cloverleaf cavity which subsidiary cavity contains a dielectric material loaded with attenuation material.

The use of dielectric material reduces the overall size required of the subsidiary cavity for a given frequency of resonance will normally enable the subsidiary cavity to be contained wholly in the nose of the cloverleaf cavity (as opposed to being partly in the nose and partly in the surrounding body of the cavity).

The number and disposition of subsidiary cavities employed will depend upon the attenuation requirements in any particular case but normally only one subsidiary cavity would be provided in any one nose.

Preferably each subsidiary cavity is of similar dimensions and the amount of dielectric material it contains is chosen having regard to the resonant frequency required of that cavity.

A subsidiary cavity with its dielectric material loaded with attenuation material may be wholly within its nose, coupling thereto from the main cloverleaf cavity being effected by one or more irises or slots.

In one embodiment of the invention a subsidiary cavity is coupled by a slot through one side of its nose into the part of the main cavity between that nose and an adjacent nose of the same cloverleaf cavity structure.

In another embodiment of the invention, a subsidiary cavity is coupled by one slot through each side of its nose into the parts of the main cavity between that nose and both adjacent noses in the same cloverleaf cavity structure.

In another embodiment of the invention a subsidiary cavity is coupled by an iris, axially substantially parallel to the axis of the tube, into the space between the cloverleaf structure in which the subsidiary cavity is provided and a coupling plate between that structure and an adjacent cloverleaf structure.

In another embodiment of the invention a subsidiary cavity is coupled by two irises, axially substantially parallel to the axis of the tube, one of the irises coupling into the space between the cloverleaf structure in which the subsidiary cavity is provided and the coupling plate on one side thereof and the other of said two irises coupling into the space between the cloverleaf structure and a coupling plate on the other side thereof.

A subsidiary cavity may also be such as to break into a main cavity through one or both sides of its nose and the dielectric material loaded with attenuation material of the cavity arranged to protrude into the main cavity. In this last mentioned case, a certain amount of attenuation of the main amplifying band of the tube will result, but this is sometimes desirable.

The extent to which said dielectric material is loaded with attenuation material will depend upon the amount of attenuation which is required. In a typical example, however, where the dielectric material is magnesium oxide, this is loaded with 2% of silicone carbide.

Along the length of the tube the number of subsidiary cavities per main cavity the nature of their coupling thereinto and the resonant frequencies of the individual cavities may be chosen to provide optimum oscillation suppression. For example, some main cavities may include no subsidiary cavities, whereas others may include one for every nose.

FIG. 1 illustrates the passbands of a clover-leaf slow wave structure.

Figure 4:
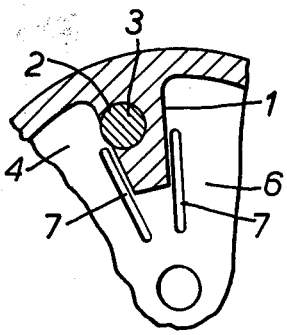
Figure 5:
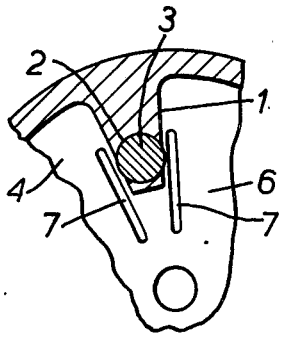
Figure 9:
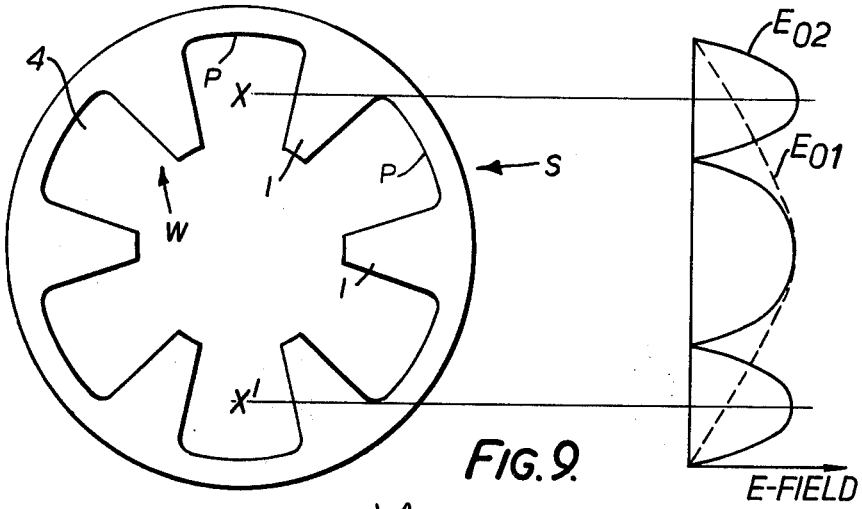
Figure 6:
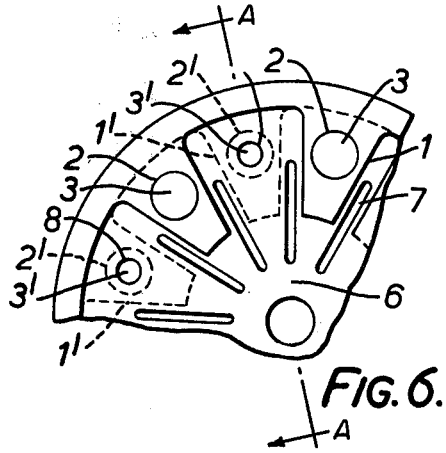
Figure 7:
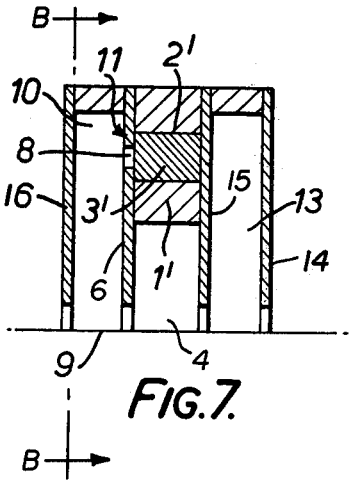
Figure 8:
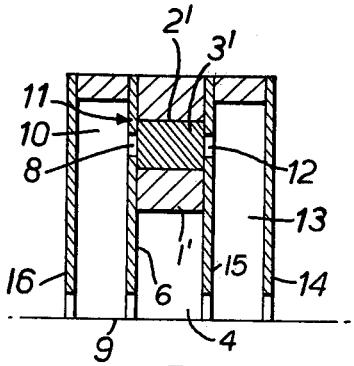

The invention is illustrated in and further described with reference to FIGS. 2 to 9 of the accompanying drawings in which FIGS. 2 to 6 are part cross sections in plan of different forms of cloverleaf slow wave structure which may be used in a travelling wave tube in accordance with the present invention, FIG. 6 being a section taken along line B—B in FIG. 7, FIG. 7 is a longitudinal section along the line A—A of FIG. 6, FIG. 8 is a longitudinal section like that of FIG. 7 but illustrating a further embodiment and FIG. 9 is an explanatory graphical diagram.

In all Figures, like references are used to denote like parts.

Figure 2:
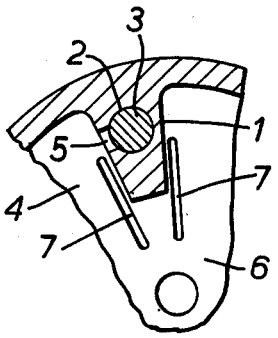

Referring to FIG. 2, for the purpose of explanation only one nose 1 of a cloverleaf slow wave structure is shown. Each cloverleaf section S as shown in FIG. 9 has a generally sinuous sidewall W which defines said noses 1 and the outward wall portions P which connect such noses. The noses 1 and wall portions P thus provide a cloverleaf boundary surface which, in cooperation with coupling plates 6 and 15, define a cloverleaf cavity 4. In accordance with common practice each cloverleaf slow wave cavity utilised in the tube in accordance with the present invention typically would have from four to twelve such noses. Within the nose 1 is a subsidiary cavity 2 which is completely filled with a dielectric material loaded with attenuation material 3. In this example and in the examples to be described hereinafter the dielectric material is magnesium oxide and this is loaded with 2% silicone carbide, the latter being the attenuating material. As will be seen, in this example the subsidiary cavity 2 with its dielectric material loaded with attenuation material 3 is wholly within the nose 1 and coupling thereto from the main cavity 4 is effected by a single slot 5 extending through one side wall of the nose 1 into the part of the main cavity 4 between that nose 1 and the adjacent nose (not shown) to one side.

The normally provided coupling plate provided between the cloverleaf cavity structure illustrated and the next along the tube is represented at 6, with its coupling slots at 7.

Figure 3:
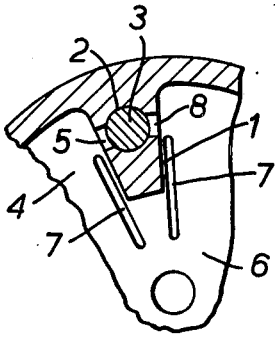

Referring to FIG. 3, the arrangement is similar to that of Fig. 2 except that in addition to slot 5, a similar slot 8 is provided extending through the other side wall of the nose 1 into that part of the main cavity 4 between the nose 1 and the adjacent nose (again not shown) to the other side.

Referring to FIG. 4, in this example the subsidiary cavity 2 is such as to break through one side of the nose 1 into the main cavity 4 and the dielectric material loaded with attenuation material 3 protrudes into the main cavity 4. With this arrangement, not only will the subsidiary cavity provide attenuation, in the range of frequencies at which oscillation can occur, but, because the dielectric material loaded with attenuation material 3 protrudes into the main cavity 4, a certain amount of attenuation of the main amplifying band of the tube will result. In some cases, however, such attenuation of the main amplifying band is desirable.

Referring to FIG. 5, the arrangement is similar to that of FIG. 4, but in this case the subsidiary cavity 2 breaks through both side walls of the nose 1 into the main cavity 4 and the dielectric material loaded with attenuating material 3 protrudes into the main cavity 4 on both sides of the nose 1.

Referring to FIGS. 6 and 7, in this example, like that of FIGS. 2 and 3, the subsidiary cavities 2 are contained wholly within their respective noses 1. Coupling to each of the subsidiary cavities 2 is effected by means of an iris 8 axially parallel to the axis 9 of the tube and coupling into the main cloverleaf cavity 10 between the cloverleaf structure 11 in which the subsidiary cavity 2 is provided and coupling plate 6. In FIG. 6, one cloverleaf structure above, as viewed, coupling plate 6 is shown in full line, whilst the cloverleaf structure 11 below, as viewed, coupling plate 6 is shown in dashed line. The reference numerals for the corresponding parts of this last mentioned cloverleaf structure bear primes.

Referring to FIG. 8, this embodiment is similar to that of FIGS. 6 and 7 except that in addition to coupling iris 8 a second coupling iris 12 is provided in coupling plate 15 which couples into the main cloverleaf cavity 13 between cloverleaf structure 11 and the coupling plate 14 on the side of structure 11 opposite to coupling plate 6.

Referring to FIG. 9, this illustrates, on the right as viewed, the distribution of electric field strengths in a cloverleaf cavity, as shown to the left as viewed, for the $E_{01}$ and $E_{02}$ bands. If cavities such as those referenced in the preceding Figures are coupled into the main cavity 4 in the planes X and X', selective attenuation of the $E_{02}$ rather than the $E_{01}$ band will result.

The number of subsidiary cavities per main cavity and the nature of their coupling thereinto and the resonant frequencies of the cavities are chosen to provide optimum oscillation suppression.

With a tube in accordance with the present invention as described above with reference to FIGS. 2 to 9, the bulk loss provided by the 2% silicone carbide is greater than the loss which could be obtained by spraying the inner walls of the subsidiary cavity with attenuative material. The dielectric filled subsidiary cavity is considerably smaller, for a given resonant frequency, than a subsidiary cavity without dielectric material so that it can be contained wholly within the nose of the cloverleaf cavity. In addition, no metallic post is required so that the resonant frequency of the subsidiary cavity tends to be more stable with temperature.

I claim:

1. A travelling wave tube of the cloverleaf slow wave circuit type having a plurality of inwardly directed noses defining a cloverleaf main cavity and including frequency selective attenuation means in the form of a subsidiary cavity confined substantially wholly within at least one of said inwardly directed noses defining said cloverleaf cavity so as to be external to such cloverleaf cavity and which subsidiary cavity contains a sufficient quantity of dielectric material loaded with attenuation material as to provide frequency selective attenuation while reducing the physical size of the subsidiary cavity, for the frequency range at which attenuation occurs, sufficiently to allow said subsidiary cavity to be substantially wholly confined within said one inwardly directed nose as aforesaid, and means for coupling said subsidiary cavity with the cloverleaf cavity associated with said one nose or with an adjacent cloverleaf cavity of the tube.

2. A tube as claimed in claim 1 and wherein only one subsidiary cavity is provided in any one nose.

3. A tube as claimed in claim 1 and wherein a plurality of said noses are each provided with a subsidiary cavity, each subsidiary cavity is of similar dimensions and the mount of dielectric material it contains is chosen having regard to the resonant frequency required of that subsidiary cavity.

4. A tube as claimed in claim 1 and wherein said subsidiary cavity with its dielectric material loaded with attenuation material is wholly within said one nose, said means for coupling being effected by one or more irises or slots.

5. A tube as claimed in claim 1 and wherein said subsidiary cavity is coupled by a slot through one side of said one nose into the part of the main cavity between said one nose and an adjacent nose of the same cloverleaf cavity structure.

6. A tube as claimed in claim 1 and wherein said subsidiary cavity is coupled by one slot through each side of said one nose into the parts of the main cavity between said one nose and both adjacent noses of the same cloverleaf cavity structure.

7. A tube as claimed in claim 1 and wherein said subsidiary cavity is coupled by an iris, extending substantially parallel to the axis of the tube, into an adjacent clover-leaf cavity.

8. A tube as claimed in claim 1 and wherein a plurality of adjacent cloverleaf cavities are provided, said subsidiary cavity is coupled by two irises, extending substantially parallel to the axis of the tube, said irises coupling into adjacent cloverleaf cavities.

9. A tube as claimed in claim 1 and wherein said subsidiary cavity is such as to break into a main cavity through one or both sides of said one nose and the dielectric material loaded with attenuation material of the cavity is arranged to protrude into the main cavity.

10. A tube as claimed in claim 1 and wherein the dielectric material is magnesium oxide and is loaded with 2% of silicone carbide.

11. A tube as claimed in claim 1 and wherein a plurality of adjacent cloverleaf cavities are provided, and some main cavities include no subsidiary cavities.

12. In a travelling wave tube of the type having a plurality of cloverleaf slow wave cavities for amplifying signals within a main operating band of frequencies, including a cloverleaf slow wave structure comprising a cloverleaf section and a pair of coupling plates, one on either side of said section, each cloverleaf section having a generally sinuous sidewall defining a cloverleaf cavity having a plurality of similar, radially inwardly directed noses connected by outward portions which cooperate to provide a cloverleaf boundary surface, the improvement wherein:

at least one of said noses is provided with a subsidiary cavity which is wholly outside the confines of said boundary surface, means for coupling said subsidiary cavity with the cloverleaf cavity associated with said one nose or with an adjacent main cloverleaf cavity, and dielectric material completely filling said subsidiary cavity and loaded with attenuation material whereby to provide frequency selective attenuation over the range of frequencies at which oscillation can occur without introducing excessive loss in said main operating band.

13. In a travelling wave tube as defined in claim 12 wherein said means for coupling said subsidiary cavity comprises a slot.

14. In a travelling wave tube as defined in claim 12 wherein said means for coupling said subsidiary cavity comprises a coupling iris.

15. In a travelling wave tube as defined in claim 12 wherein said subsidiary cavity intersects said boundary surface thereby directly to open into that main cloverleaf cavity associated with said one nose and define said means for coupling the subsidiary cavity, and wherein said dielectric material protrudes into such main cloverleaf cavity.

* * * * *